United States Patent [19]

Karasawa

[11] 4,353,033

[45] Oct. 5, 1982

[54] MAGNETIC POLE STRUCTURE OF AN ISOCHRONOUS-CYCLOTRON

[75] Inventor: Takashi Karasawa, Fuchu, Japan

[73] Assignee: Rikagaku Kenkyusho, Wako, Japan

[21] Appl. No.: 124,939

[22] Filed: Feb. 26, 1980

[30] Foreign Application Priority Data

Mar. 7, 1979 [JP] Japan ..... 54-26571

[51] Int. Cl.[3] ..... H05H 13/00

[52] U.S. Cl. ..... 328/234; 313/62

[58] Field of Search ..... 328/234, 233, 235, 236; 313/62, 154, 156; 335/281

[56] References Cited

U.S. PATENT DOCUMENTS

| | | | |
|---|---|---|---|
| 2,872,574 | 2/1959 | McMillan et al. | 313/154 X |
| 2,906,910 | 9/1959 | Dyer et al. | 313/156 |
| 2,935,691 | 5/1960 | Wideroe | 328/233 |
| 3,024,379 | 3/1962 | Verster | 328/234 X |
| 3,789,335 | 1/1974 | Delphin et al. | 313/62 |

*Primary Examiner*—Robert Segal

*Attorney, Agent, or Firm*—Kerkam, Stowell, Kondracki & Clarke

[57] ABSTRACT

Disclosed is a magnetic pole structure of an isochronous-cyclotron having a single helical winding for generating a complementary magnetic field to add to the main magnetic field. The number of turns of the winding varies with radius, and a controlled electric current flows the single winding to build the complementary magnetic field as required.

11 Claims, 2 Drawing Figures

MAGNETIC POLE STRUCTURE OF AN ISOCHRONOUS-CYCLOTRON

This invention relates to an improvement of the magnetic pole structure of a cyclotron, particularly an isochronous-cyclotron.

An isochronous-cyclotron is herein defined as a particle accelerator in which the particles are accelerated and driven to follow different circular pathes for a same period irrespective of the different radius of the circular pathes.

In such a particle accelerator the radial distribution of magnetic flux $B_{(r)}$ must be proportional both to the square of radius and to the maximum kinetic energy to the three over two power. This can be mathematically given as follows:

$$B_{(r)}=Bo+KEm^{3/2}r^2,$$

where "Bo" stands for the strength of the center of the magnetic field, and "K" is a constant. A conventional structure of magnetic pole to meet this requirement comprises a plurality of independent, concentric circular winding sets, which are called "circular trimming coils", lying on the surface of the magnetic pole core. In operation different electric currents, which are controlled in terms of magnitude and directions, are allotted and supplied each to the winding sets, thereby building a complementary magnetic field mathematically given in the term, "$KEm^{3/2}r^2$". Such a complementary winding design, however, is difficult to make, and an electric current source installation which is capable of supplying discrete and definite controlled electric currents to the respective windings is economically disadvantageous. Still disadvantageously, when an intervenient complementary magnetic field is required in operation, a corresponding intermediate series of discrete electric currents to be allotted to different winding sets must be determined from known series of electric currents according to the interpolation or extrapolation, and then a computer must be used to find the correct answer in a possible minimum time.

The object of this invention is to provide an improved magnetic pole structure of an isochronous-cyclotron which is simple and easy to operate.

To attain this object a magnetic pole structure according to this invention comprises on the top surface of each of the two opposing magnetic poles, a single spiral winding of which the number of turns per unit radial length, or "winding density" is proportional to radius.

Figure 1:
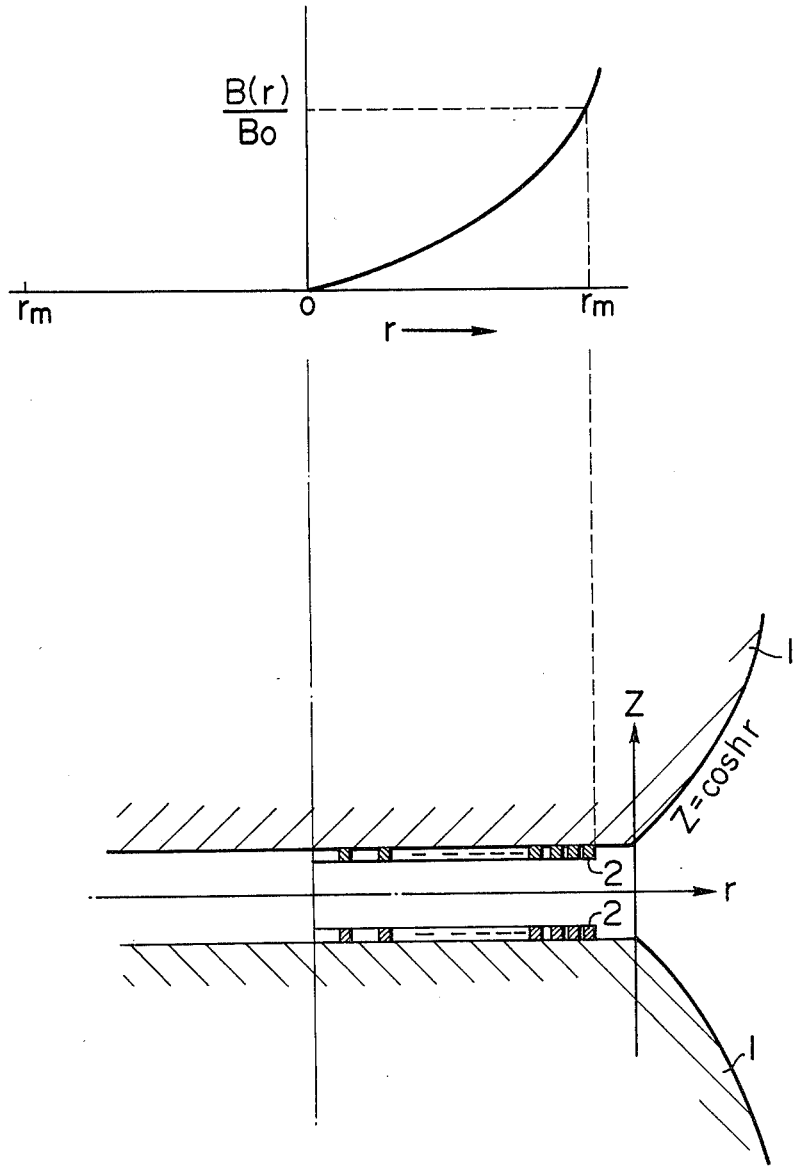
Figure 2:
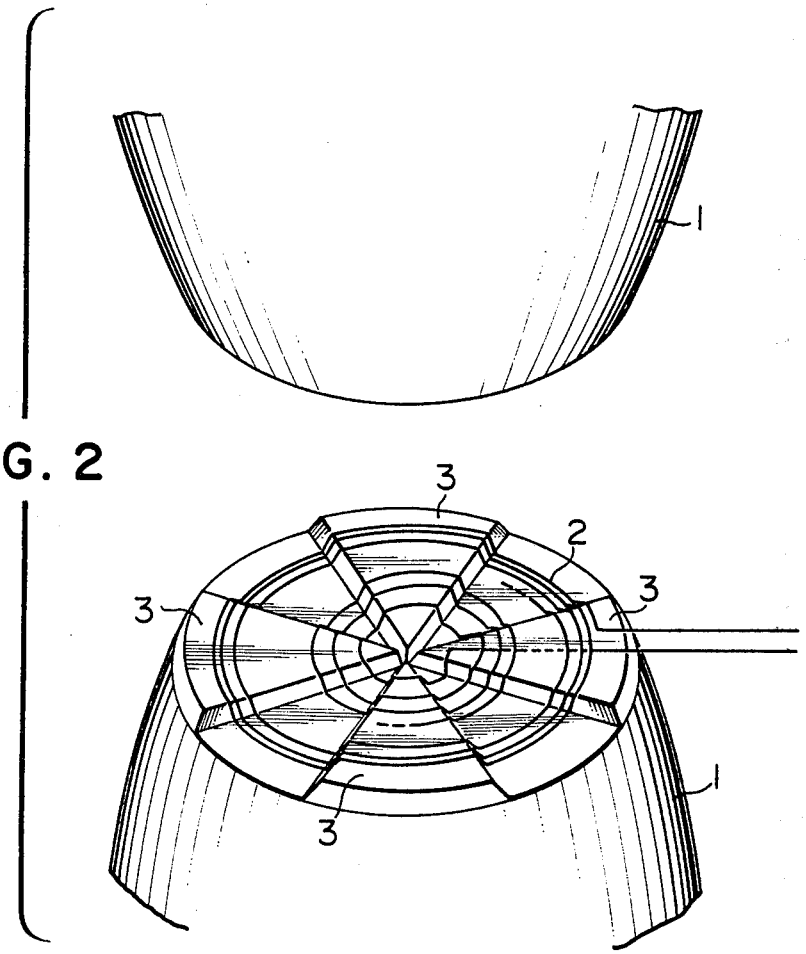

This invention will be better understood from the following description which is made with reference to the attached drawings:

The upper half of FIG. 1 shows the radial distribution of relative strength of the magnetic field which is required in an isochronous-cyclotron, whereas the lower half of FIG. 1 shows a longitudinal section of a magnetic pole structure according to this invention in the corresponding relationship to the upper graph, and FIG. 2 shows a perspective view of a magnetic pole structure according to one embodiment of this invention.

Referring to the drawings, a pair of opposing tapered electromagnetic poles 1 are used for establishing the main magnetic field. The tapering shape of the magnetic pole assures that the radial distribution of relative strength of the magnetic field remains immutable even if the strength of the main magnetic field should change. A single helical winding 2 whose winding density is proportional to radius, is put on the top surface of the magnetic pole. Assuming that a given constant electric current "I" flows in the helical winding, the strength of the resulting complementary magnetic field in radial directions "$B_{(r)}$" is determined as follows:

The number of turns at a given radial distance "r" from the center of the magnetic pole is equal to $nr\Delta r$, wherein "n" stands for the winding density at a reference radius, and then the strength of the magnetic field at the given distance "r" is determined from the following equation:

$$B(r)=\int_0^r nr\,I\,dr=\tfrac{1}{2}n\,Ir^2$$

As is apparent from this equation, if a given constant electric current flows in the winding, a magnetic field whose strength is proportional to the square of radius will result. In this connection if an electric current whose magnitude is proportional to the maximum kinetic energy of particles to the three over two power, flows in the helical winding, the complementary magnetic field as required in an isochronous-cyclotron will be established.

Referring to FIG. 2, there is shown a magnetic pole structure according to one embodiment of this invention. As shown, this particular embodiment uses two opposing tapered magnetic poles 1. In place of the tapered magnetic poles 1, however, cylindrical magnetic poles (not shown) can be used for a relatively weak strength of magnetic field which causes a negligible saturating effect at the pole edge, as for instance 10,000 gauss or less magnetic field. The converging side of the tapered pole is preferably shaped to conform "cosh r" or "$\epsilon r$", thereby moderating the magnetically saturating effect at the pole edge, and reducing the malfunction on the resulting magnetic field.

As shown in FIG. 2, four iron shims 3 are put on the top surface of each magnetic pole so that the magnetic field is controlled in the circumferential direction or in "azimuth". The winding 2 lies over the iron shims 3. They, however, can be put under the shims 3. The four shims 3 are grouped in pairs, the shims of each pair being positioned diametrically opposite each other.

What is claimed is:

1. An isochronous cyclotron having a magnetic pulse structure comprising a pair of opposing electromagnetic poles for establishing a magnetic field, said poles having opposing surfaces and a single helical winding on each opposing pole surface, the number per turns per unit radial length of each winding being proportional to the radius of the pole at the surface.

2. An isochronous cyclotron as set forth in claim 1 further including electric current source means adapted to be electrically connected to each said helical winding for supplying to each winding an electric current the magnitude of which is proportional to $Em^{3/2}$, where Em is the kinetic energy of accelerated particles of the cyclotron.

3. An isochronous cyclotron as set forth in claims 1 or 2 wherein the opposing electromagnetic poles are tapered.

4. An isochronous cyclotron as set forth in claims 1 or 2 wherein the electromagnetic poles are cyclindrical.

5. An isochronous cyclotron as set forth in claim 3 including a plurality of iron shims on each pole surface for controlling the magnetic field in the circumferential direction.

6. An isochronous cyclotron as set forth in claim 4 including a plurality of iron shims on each pole surface for controlling the magnetic field in the circumferential direction.

7. An isochronous cyclotron as set forth in claim 5 wherein the tapered poles are shaped so as to moderate the magnetically saturating effect at each pole edge.

8. An isochronous cyclotron as set forth in claim 5 wherein the winding lies over the iron shims.

9. An isochronous cyclotron as set forth in claim 6 wherein the winding lies over the iron shims.

10. An isochronous cyclotron as set forth in claim 5 wherein the shims on each pole surface number four and are grouped in pairs, the shims of each pair being positioned diametrically opposite each other.

11. An isochronous cyclotron as set forth in claim 6 wherein the shims on each pole surface number four and are grouped in pairs, the shims of each pair being positioned diametrically opposite each other.

* * * * *